US006965744B1

(12) United States Patent
Housel

(10) Patent No.: US 6,965,744 B1
(45) Date of Patent: Nov. 15, 2005

(54) METHOD AND APPARATUS FOR TONER-DRIVEN PRINTER CONTROL

(75) Inventor: Edward M. Housel, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 83 days.

(21) Appl. No.: 10/668,392

(22) Filed: Sep. 23, 2003

Related U.S. Application Data

(60) Provisional application No. 60/414,823, filed on Sep. 30, 2002.

(51) Int. Cl.[7] ..... G03G 15/00
(52) U.S. Cl. ..... 399/82; 399/83; 399/85
(58) Field of Search ..... 399/82, 83, 84, 399/85, 86, 87; 358/468; 347/19, 43

(56) References Cited

U.S. PATENT DOCUMENTS 5,760,928 A * 6/1998 Motoyama et al.
6,236,816 B1 * 5/2001 Warbus et al. ..... 399/82

* cited by examiner

*Primary Examiner*—Arthur T. Grimley
*Assistant Examiner*—Ryan Gleitz
(74) *Attorney, Agent, or Firm*—Brinks Hofer Gilson and Lione; Richard A. Romanchik

(57) ABSTRACT

Disclosed herein are economical methods and apparatuses for controlling a printer based on whether there are toner stations designated as "special toner stations." Specifically, a printer running a print job is controlled based on whether a hold jobs mode is enabled only for the special toner stations. If the hold mode procedure is not enabled, printing is then allowed. If the hold jobs mode is enabled only for special toner stations, the identity of the installed toner is determined. Additionally, if the hold mode procedure is enabled, the print job is subjected to additional procedures before being allowed to print. These additional procedures may include determining if any predefined attributes exist for the job ticket and automatically applying these attributes, placing the print job into a "hold status," permitting manual changes to be made to the print ticket, and forwarding notification of the print job upon its completion.

6 Claims, 8 Drawing Sheets

METHOD AND APPARATUS FOR TONER-DRIVEN PRINTER CONTROL

RELATED APPLICATION

This application claims priority to U.S. Provisional Patent Application 60/414,823, titled "Method And Apparatus For Toner-Driven Printer Control," which was filed on Sep. 30, 2002, and which is incorporated herein by reference in its entirety.

FIELD OF THE INVENTION

The present invention relates to digital printers, and more particularly to digital printers controlled based on whether a hold jobs mode is enabled only for the special toner stations.

BACKGROUND

Modern printers, both commercial and non-commercial, generally render images on paper in response to information communicated from a computer. They include a print engine which performs the physical act of printing, including feeding the paper and printing the image on the paper. For non-commercial printers, which are those generally produced for home or small-business use, the printer is the print engine and is usually coupled to a general purpose computer from which the documents to be printed are supplied. Because non-commercial printers are coupled to general purpose computers, software can be placed on the general purpose computer enabling the non-commercial printers to offer many of the automated features offered by commercial printers.

In contrast to the non-commercial printers, commercial printers, which are generally used by commercial print shops, can print at a faster rate and higher volume. A general diagram of a typical known commercial printer is shown in FIG. 1 and indicated by reference number 1. The printer 1 basically includes a print engine 8, a dedicated computer 2 and, if necessary, an interface 5. The dedicated computer is coupled to the interface via computer coupling 4 and the interface is coupled to the print engine via interface coupling 6. If the interface is not needed, the dedicated computer 2 is coupled directly to the print engine 8 via the computer coupling 4. The print engine 8 performs the physical act of printing, as does the non-commercial printer. However, the commercial printer's print engine 8 often offers additional physical capabilities such as, duplexing, collating, stapling and binding. Commercial printers 1 generally include a dedicated computer 2 that is used solely to operate and control the print engine. This dedicated computer 2 generally includes a processor, memory, and input and output mechanisms and offers such automated features relating to the print job. The dedicated computer may also be connected to a network such as a LAN, an intranet or the Internet. In some cases, because of various incompatibilities between the dedicated computer 2 and the print engine 8, an interface 5 is needed so that these components can communicate with each other. Hereinafter, unless referring specifically only to a commercial printer, the term "print engine" will be used to denote both a non-commercial printer and the print engine of commercial printer.

Many of the commercial and non-commercial printers are capable of printing many types of print jobs. A print job includes both the documents that are to be printed and the printing instructions associated with those documents. The printing instructions (the "job ticket") may specify almost any attribute the printed document is to have which, at a minimum, includes the name of the print job (the "job name") and the number of copies to be printed. The job ticket may also include the type of ink ("toner"), paper type or font to be used (font names may also be part of the print job itself), and may be specified by a customer, other individual, the printer or may be mandated by the type of print job. The job ticket may be written or printed on paper, stored electronically or optically on a portable memory apparatus, such as a disk, or stored in the memory of a dedicated or general purpose computer.

Because different print jobs may require different types of toner, some printers are capable of printing with a variety of toner types. These "multi-toner" printers enable printing for almost every conceivable purpose, application and industry and are limited only by the types of toner available. The almost limitless range of colors available enable printing for virtually any type of commercial, personal, or artistic endeavor. Additionally, toner is available in magnetically-readable form which allows magnetically-readable characters to be printed. Types of toner include, but are not limited to, toners of various colors and toner in magnetically-readable and non-magnetically readable form, which may also come in various colors.

In order to accommodate the many different types of toner, various methods and mechanisms have been devised. For instance, many non-commercial printers, such as personal laser printers, are adapted to use exchangeable toner cartridges that may each contain a different type of toner. In another example, some commercial printers are adapted to use interchangeable toner stations, wherein each toner station contains a different type of toner. In some cases, each toner station may be dedicated to a single type of toner.

A desirable property for printers is the ability to determine the type of toner installed in the printer. This property is particularly desirable for printers that print with both magnetically-readable and non-magnetically-readable toner. Magnetically-readable toner is used to create documents that will be read using some type of magnetic ink character recognition ("MICR") method, often without the aid of human intervention. These MICR documents include financial documents such as checks. Because these MICR documents will be read magnetically, it is crucial that magnetically-readable toner ("MICR toner") be used when the MICR documents are printed. Additionally, because MICR toner is significantly more expensive than non-magnetically-readable toner, it is also important that documents that do not have to be magnetically read are not printed with MICR toner.

To identify the toner installed in a printer, some methods involve identifying the toner station installed in the printer. This method is generally reliable because toner cartridges for non-commercial printers contain only one type of toner and toner stations for commercial printers are usually dedicated to a single type of toner. Therefore, identifying the toner cartridge or toner station effectively identifies the toner. One method for determining the type of toner station or cartridge installed in a printer is, of course, visual inspection by a human. While this method may sometimes be possible for non-commercial printers, this method is often not practical for commercial printers because visual access to the toner station may be difficult. Additionally, people often forget to make such an inspection, particularly in rushed or otherwise stressed situations. In the case of a large print job, many pages may be printed and wasted before the incorrect toner is identified, if ever. Another known method for use with printers that use exchangeable toner stations includes visual inspection by a laser scanner. U.S. Pat. No. 6,236,816 (the "'816 patent") discloses a method that uses a barcode to identify the type of toner which is placed on each toner station and a laser scanner placed on the printer to read the barcode. When the toner station is coupled to the printer, the laser scanner optically reads the barcode and a processor matches the barcode reading with entries in a table to identify the coupled toner station. Unfortunately, this method requires the use of an expensive laser scanner.

A method for determining the type of toner installed in a printer that overcomes these shortcomings is disclosed in U.S. patent application entitled: "METHOD AND APPARATUS FOR IDENTIFYING TONER," inventors, Friedrich et al., filed concurrently with and incorporated by reference into this disclosure (the "Friedrich disclosure"). The method is implemented by a toner identification apparatus which identifies the toner station installed in a printer and includes a toner identification module, a display device, and an input device. A job ticket algorithm determines whether the installed toner station is the correct toner station for a given job selection (job ticket). Additionally, if the toner station installed in the printer contains MICR toner, the job station algorithm mandates a security procedure that must be carried out in order for printing to be allowed. In response to the job ticket algorithm, the toner station creates a control signal that provides instructions to the print regarding whether to allow a selected print job to print.

Another desirable property for printers is the ability to distinguish for special treatment print jobs that use certain toner for special treatment. Known printers either immediately allow all print jobs to print or subject all print jobs to the same pre-printing procedures. However, in some cases, it is important to distinguish print jobs using certain types of toner because these print jobs need to be given additional attention. This additional attention may be as simple as reviewing the attributes of the print job before printing, or may involve a more complicated set of procedures, including security precautions (such as entering a password or obtaining authorization), verification of the job attributes, and identification of the installed toner. In one example, print jobs using MICR toner require additional attention. Not only do MICR print jobs require a specific toner (MICR toner), in addition, because these print jobs create instruments that can distribute funds, it is important to ensure that the job attributes are correct because these instruments will be read magnetically. Therefore, extra procedures, such as verifying the job attributes and providing extra security measures are extremely beneficial.

SUMMARY

Disclosed herein are economical methods and apparatuses for controlling a printer based on the toner installed in the printer and the print ticket describing the attributes of a print job. The apparatuses may be easily implemented in existing printer hardware. Specifically, the methods and apparatuses control a printer using a toner-control pre-printing procedure. The toner-control pre-printing procedure may be enabled for all toner stations or for only certain special toner stations. If the toner-control pre-printing procedure is only enabled for special toner stations, the procedure will ascertain the identity of the toner station actually installed in the printer. When a print job, including a job ticket, is entered into a printer, the toner-control pre-printing procedure determines whether it is enabled for all toner stations or only special toner stations. If it is enabled only for special toner stations, it identifies the toner station or toner cartridge installed in the printer. If the toner station installed in the printer is not one of the special toner stations, the print job will be allowed to print immediately. However, if the print station is one of the special print stations or if the toner-control pre-printing procedure is enabled for all toner stations, the print job is subjected to additional procedures before the print job is allowed to print. These additional procedures, at a minimum, determine if any predefined attributes exist for the job ticket. If predefined attributes exist, they are automatically applied to the job ticket. In some cases, the job ticket is then immediately allowed to print. In other cases, the print job is placed into a "hold status." This hold status enables the print ticket to be reviewed and requires the print ticket to be approved. Additionally, the operator of the printer (the "operator") may be allowed to make certain manual changes to the attributes of the print ticket. Finally, notification of the print job may be forwarded to a select individual or select individuals upon completion of the print job.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Disclosed herein are economical methods and apparatuses for controlling a printer based on the toner installed in the printer and the job ticket describing the attributes of a print job. Specifically, the methods and apparatuses control a printer using a toner-controlled pre-printing procedure. When a print job is entered into the printer, if enabled, this toner-controlled pre-printing procedure determines whether the procedure is to be used for all toner stations or only for certain toner stations ("special toner stations"). If the toner-controlled pre-printing procedure is to be used only for special toner stations, the procedure then identifies the toner station installed in the printer (the "installed toner station") using a toner station identification procedure. If the toner station identification procedure determines that the toner station installed in the printer is not a special toner station, the print job will be allowed to print immediately.

If, however, the toner-controlled pre-printing procedure determines that the toner station is a special toner station or if the toner-controlled pre-printing procedure is to be used for all toner stations, a hold mode procedure subjects the print job to additional procedures before the print job is allowed to print. These additional procedures, at a minimum, determine if any predefined attributes exist for the job ticket. In some cases, if any predefined attributes exist, they are automatically applied to the job ticket and the job ticket is allowed to print. In other cases, if any predefined attributes exist, they are automatically applied and the print job is placed into a "hold status" as are print jobs without predefined attributes. This hold status enables the print ticket to be reviewed and requires the print ticket to be approved. Additionally, the operator of the printer (the "operator") may be allowed to make certain manual changes to the attributes of the print ticket. Finally, notification of the print job may be forwarded to a select individual or select individuals upon completion of the print job.

Figure 2:
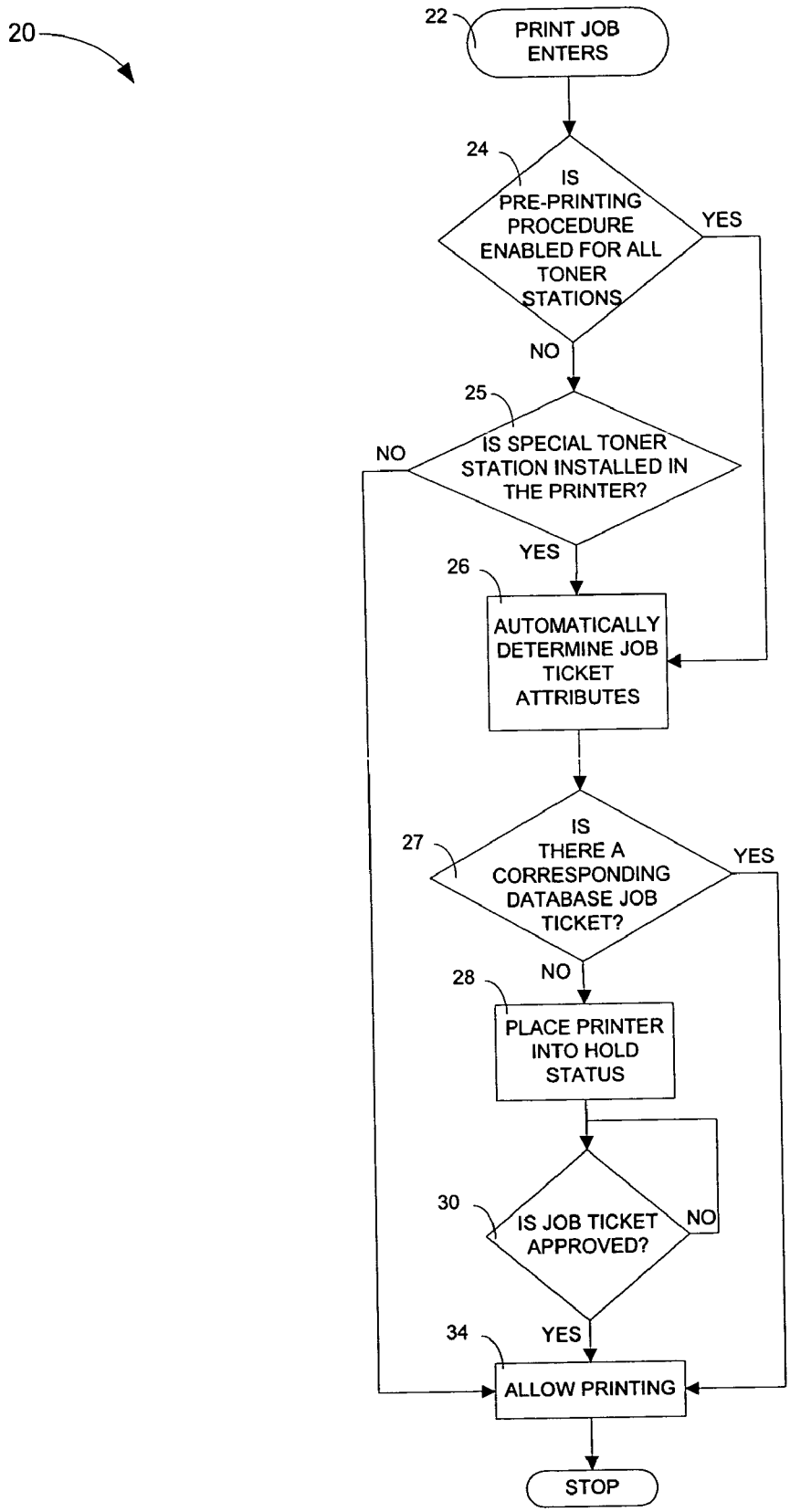
FIG. 2 is a flow chart of a preferred embodiment of a toner-controlled pre-printing procedure.

A preferred embodiment of the toner-controlled pre-printing procedure is shown in FIG. 2 and denoted by reference number 20. The toner-controlled pre-printing procedure generally includes a toner station identification procedure, a hold mode procedure, and allowing printing. It may additionally include sending notification. The toner station identification procedure generally includes determining if the pre-printing procedure is enabled for all toner stations 24, if the toner-control pre-printing procedure is not enabled for all toner stations but only for special toner stations, determining whether a special toner station is installed in the printer 25 and if the installed toner station is not a special toner station, printing is allowed 34. The hold mode procedure generally includes automatically determining job ticket attributes 26, determining whether there is a corresponding database job ticket 27 and if there is no corresponding database job ticket, placing the printer into a hold status 28, and determining if the job ticket is approved 30; however, if there is a corresponding database job ticket, steps 28 and 30 are omitted and printing is allowed 34.

Determining whether the toner-control pre-printing procedure is enabled for all toner stations 24 involves checking a pre-established list of special toner stations. Prior to running any print jobs, a list of special toner stations will be included in some type of memory device. If this list is empty, toner-control pre-printing procedure is enabled for all toner stations. If the list is not empty, the toner-control pre-printing procedure is enabled for only the toner stations included in the list. Determining whether a special toner station is installed in the printer 25 generally includes the operator manually inputting the identity of the installed toner station or the procedure automatically determining the identity of the installed toner station using a known technique such as those described in the Friedrich disclosure and the '816 patent. The printer station is generally identified by a unique name or other designation and this name or designation will be compared to those contained in the list of special toner stations. If the installed toner station is included in the list of special toner stations, it is a special toner station and the hold mode procedure will be activated. However, if the installed toner station is not a special toner station, the print job will be allowed to print 34 in any known manner.

The hold mode procedure generally forces the print job into a holding state (the "hold status") to compel the operator to review the attributes of the print ticket. The hold mode procedure is activated for special toner stations because these special toner stations include toner that is usually associated with print jobs requiring extra attention. For example, toner stations with MICR toner are used for MICR print jobs. Because MICR print jobs require specific fonts and security provisions (such as limiting the number of copies), MICR print jobs should be given extra attention to help ensure that the attributes of the print job (the "print job attributes") are correct. Similar attention may be needed for some color print jobs. In any case, any toner station may be designated as a special toner station.

Additionally, the hold mode procedure may automatically determine the attributes of the job ticket. Automatically determining the attributes of a print ticket generally includes, applying overrides and suggestions and applying attributes of the corresponding database job ticket. Overrides and suggestions and database job tickets are generally entered into the system and enabled before the print job is run and may define some or all of the attributes of the job ticket. Overrides are attribute values that must be used for a specified job ticket. For example, if an MICR toner station is used, the number of copies may be set to one and defined as an override and the font may be specified as a specific MICR font and also defined as an override. If the hold mode procedure applies, when overrides are defined for a job ticket and a job ticket with the same name is entered, the attributes specified in the override are applied to the job ticket automatically even if the job ticket already has some value for the attributes specified by the override. Suggestions are also attribute values that are automatically applied to the job ticket in the same manner as overrides. However, attributes defined as suggestions are merely suggestions and are only applied if the job ticket does not contain a value for the attributes of the suggestion.

Attributes of a job ticket may also be applied automatically from values stored in a database. Before a job ticket is entered various job tickets and their associated attributes may be defined in a database. These database job tickets usually include at least a job name (or other designation) and the number of copies to be printed. If a job ticket entered into the printer (the "entered job ticket") has the same job name as the database job ticket, the attributes of this corresponding database job ticket will automatically be applied to the attributes of the job ticket. The attributes assigned by overrides, suggestions and corresponding database job tickets may replace all or some of the attributes of a job ticket depending on which attributes are defined. Alternatively, if overrides, suggestions and corresponding database job tickets are not enabled or defined for an entered job ticket, none of the job ticket attributes will be replaced.

Figure 3:
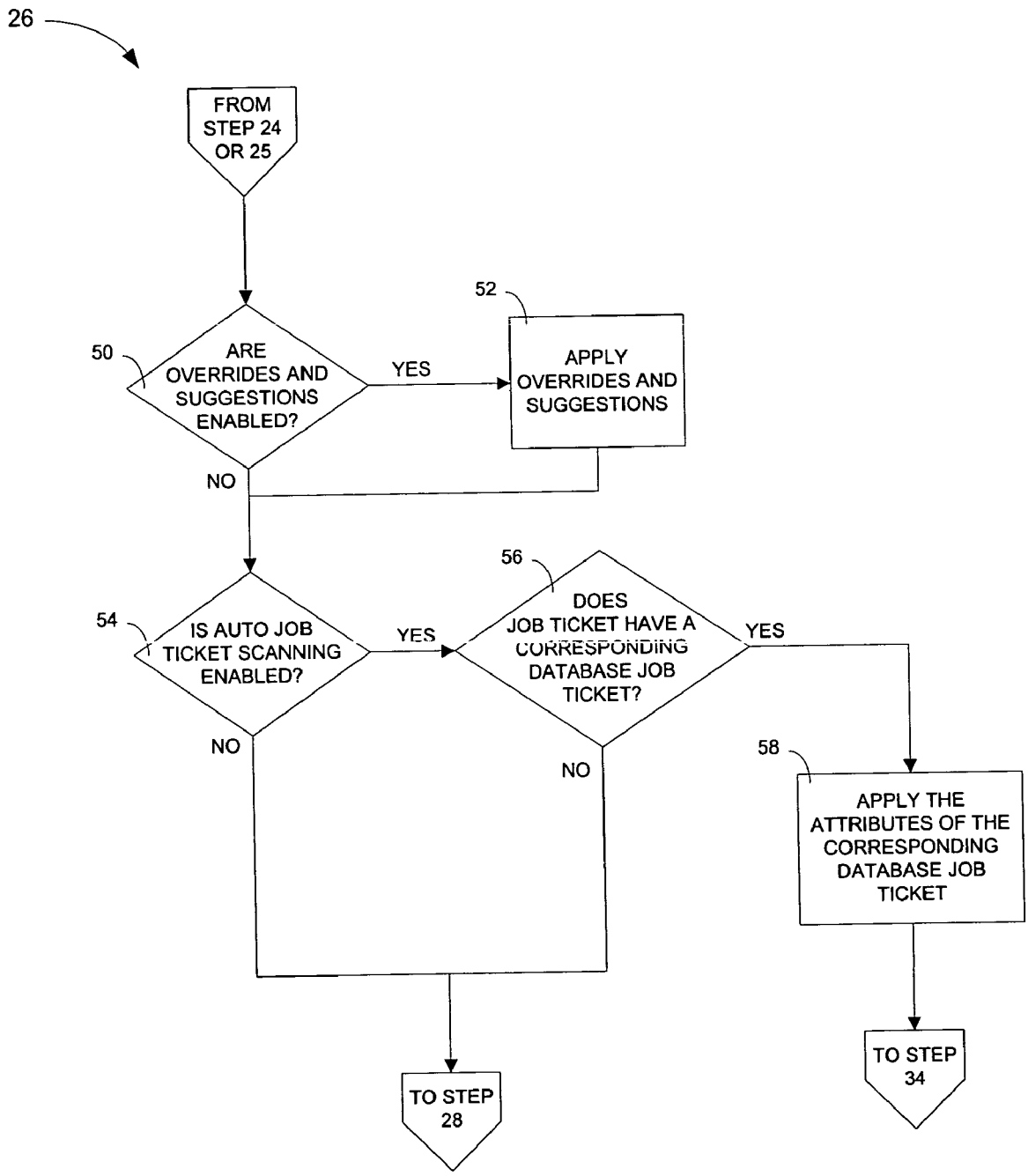
FIG. 3 is a flow chart of a preferred embodiment of a method for automatically determining job ticket attributes.

An example of a preferred embodiment of the step of automatically determining job ticket attributes 26 is shown in FIG. 3. If, in the previous step 24 it had been determined that the toner-control pre-printing procedure is enabled for all toner stations, or in the previous step 25 it had been determined that a special toner station was installed in the printer, a determination is made as to whether overrides and suggestions have been enabled 50. If overrides and suggestions have been enabled and if any exist for the job ticket, they are automatically applied to the attributes of the job ticket. After the overrides and suggestions are automatically applied, or if overrides and suggestions are not enabled, a determination is made as to whether auto job ticket scanning is enabled 54. Auto job ticket scanning extracts the job name from the job ticket and then determines if there are any corresponding database job tickets 56. If a corresponding job ticket exists, the attributes of the corresponding job ticket will be applied to the attributes of the job ticket 58. After the attributes of the corresponding job ticket are applied to the attributes of the job ticket, steps 28 and 30 of FIG. 2 will be omitted and the print job will be allowed to print 34. However, if there was no corresponding database job ticket or if auto job ticket scanning was not enabled, the print job will be placed into a hold status 30.

Figure 4:
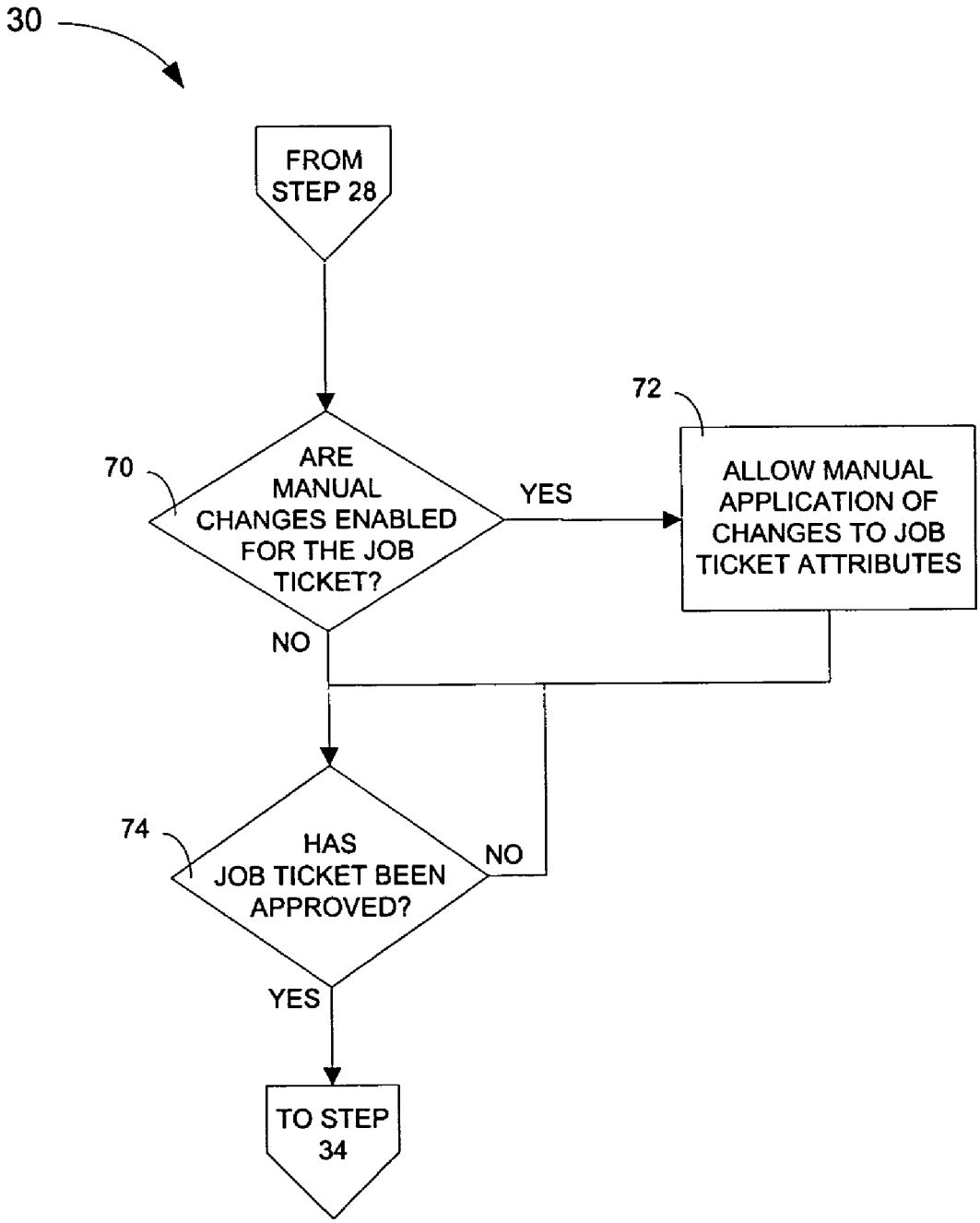
FIG. 4 is a flow chart of a preferred embodiment of a method for determining if a job ticket has been approved.

When the print job is placed into the hold status 28, the operator is given the opportunity to review the print job. In fact, the print job will remain in the hold status 28 until the job ticket is approved 30. The job ticket may be approved by the operator or by another individual with authority to approve the print job. When determining whether to approve the print job 30, the operator may have the opportunity to alter or change some or all of the job ticket attributes. Whether the operator can change any of the attributes depends on whether manual changes have been enabled for the print job. As shown in FIG. 4, when the operator is approving the job ticket 30, the operator may manually apply changes to the job ticket attributes 72 only if manual changes have been enabled for the job ticket 70. Again, this enablement is done prior to entering a job ticket. After the operator has had made any desired manual changes or if manual changes are not enabled for the job ticket, it will be determined if the job ticket has been approved 74 until the job ticket is actually approved. As shown in FIG. 2, once the job ticket has been approved 30 or if the toner-control pre-printing procedure was not enabled for all toner stations and the installed toner station is not a special toner station printing will be allowed 34.

Figure 5:
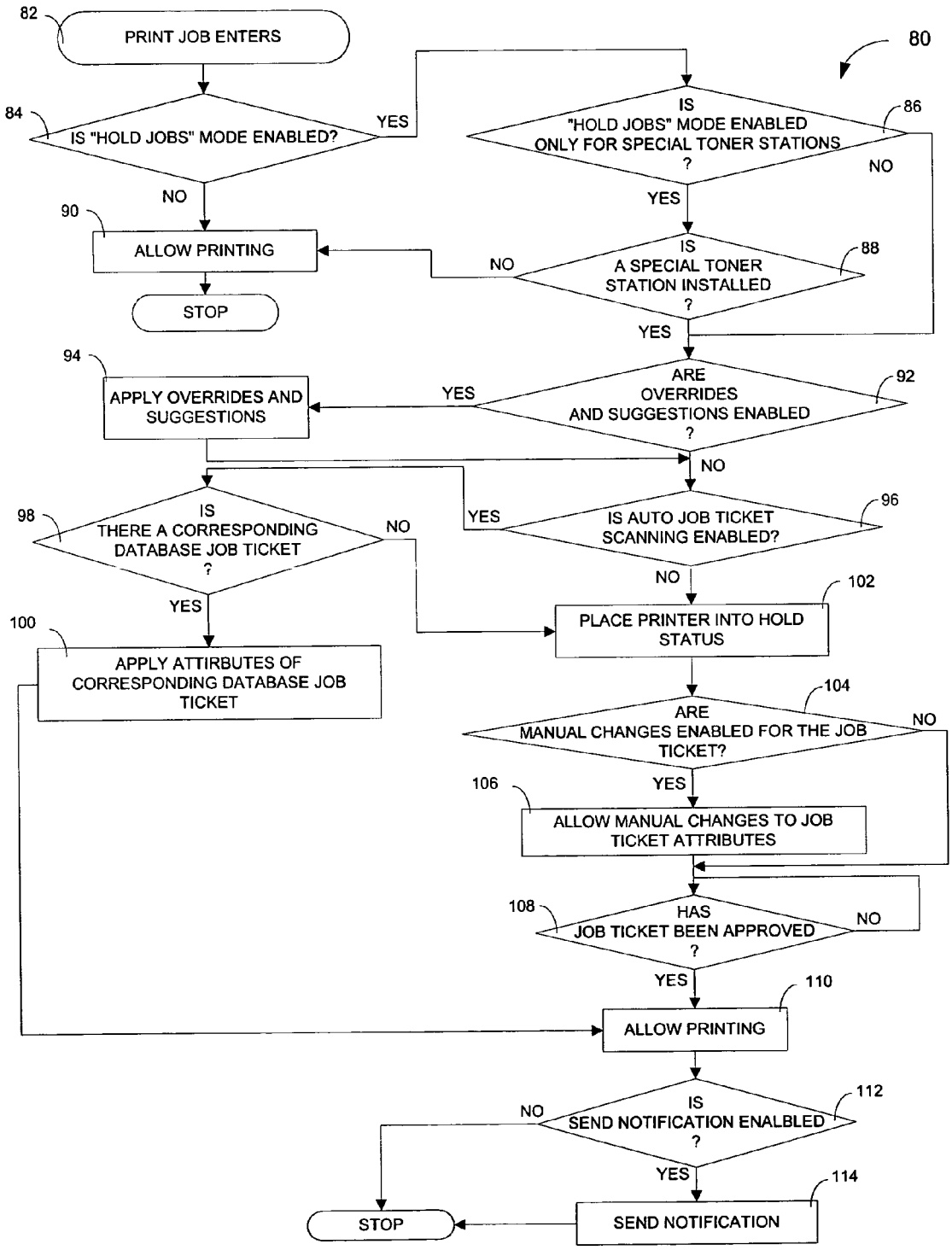
FIG. 5 is a preferred embodiment of a toner-controlled pre-printing procedure wherein the MICR toner station is a special toner station.

FIG. 5 shows an example of the toner-controlled pre-printing procedure wherein an MICR toner station is defined as a special toner station 80. Toner stations may be defined as special toner stations by including their name in a list of special toner stations. Alternately, one or more toner stations may be presented from which the special toner stations may be chosen. Generally, determining which toner stations are special toner stations is done prior to entering any print jobs. After a print job including a print ticket enters 82, it will be determined whether the hold jobs mode is enabled 84, which determines whether the toner-controlled pre-printing procedure is activated. Enabling or disabling the hold jobs mode is done prior to entering a print job. If the hold jobs mode is enabled, the toner-controlled pre-printing procedure will be activated and it will be determined for which toner stations the hold jobs mode is enabled 86. In this case, the hold jobs mode has been enabled for MICR toner stations. However, it must be determined if the hold jobs mode is enabled for all toner stations or only special toner stations 86. If the hold jobs mode is enabled only for special toner stations, the toner-controlled pre-printing procedure will activate the toner station identification procedure. It will then be determined if the toner station installed in the printer is a special toner station. If the MICR toner station is not installed in the printer, the print job will be allowed to print 90.

However, if a special toner station, such as an MICR toner station, is installed, or if the hold jobs mode is enabled for all toner stations, the hold mode procedure will be activated. The print job will be placed into a hold status and job ticket attributes will be automatically applied. Some, all or none of the job ticket attributes may be automatically applied depending on how or whether overrides, suggestions and database job tickets are defined. Automatically determining job ticket attributes includes applying existing overrides and suggestions and applying the attributes of a corresponding database job ticket to the job ticket (steps 92, 94, 96, 98 and 100). Before overrides and suggestions are applied 94, it is determined whether overrides and suggestions are enabled 92. Whether or not overrides and suggestions are applied, it is then determined whether auto job ticket scanning is enabled 96. If auto job ticket scanning is enabled it will be determined if a corresponding database job ticket 98 exists. If there is a corresponding database job ticket, the attributes of the database job ticket will be applied to the job ticket 100 and the job will be allowed to print 110, thus skipping steps 104, 106 and 108. However, if there is no corresponding database job ticket or if auto job ticket scanning is not enabled 96, the printer will be placed into the hold status 102. However, in another embodiment, the steps involving overrides and suggestions, 92 and 94 may be eliminated. In another embodiment, the steps relating to auto job scanning and corresponding database job tickets, 96, 98 and 100 may be eliminated. In yet another embodiment that includes the steps relating to auto job scanning and corresponding database job tickets, 96, 98 and 100, after the attributes of a corresponding job ticket are applied 100, the printer (and thus the print job) may be place into hold status 102 and not be immediately allowed to print.

While the print job is placed into the hold status 102, it will be determined if manual changes are enabled for the job ticket 104. If manual changes are enabled, the operator will be able to make changes to the job ticket 106 attributes. However, the step of enabling manual changes 104 may be eliminated. As a convenience to the operator, the operator may be permitted to apply all the attributes from an existing job ticket (possibly stored in a database) to the current job ticket. This could be done by selecting a job ticket name from a list of job ticket names. Afterwards, the operator may choose to modify an individual attribute of the job ticket. It will then be determined if the job ticket has been approved 108. This determination will continue until the job ticket is approved. The job ticket may be approved by the operator or by another individual. Once the job ticket is approved, printing will be allowed 110. Finally, after printing is allowed 110, it will be determined if send notification is enabled 114. The send notification feature allows print jobs associated with special toner stations to be tracked and monitored. Before the print job is entered, an individual may enable this feature and specify to whom the notification is to go and what the notification is to contain. Preferably, the notification will contain the job ticket, including all job ticket attributes, but may contain any information relating to the print job.

Figure 6:
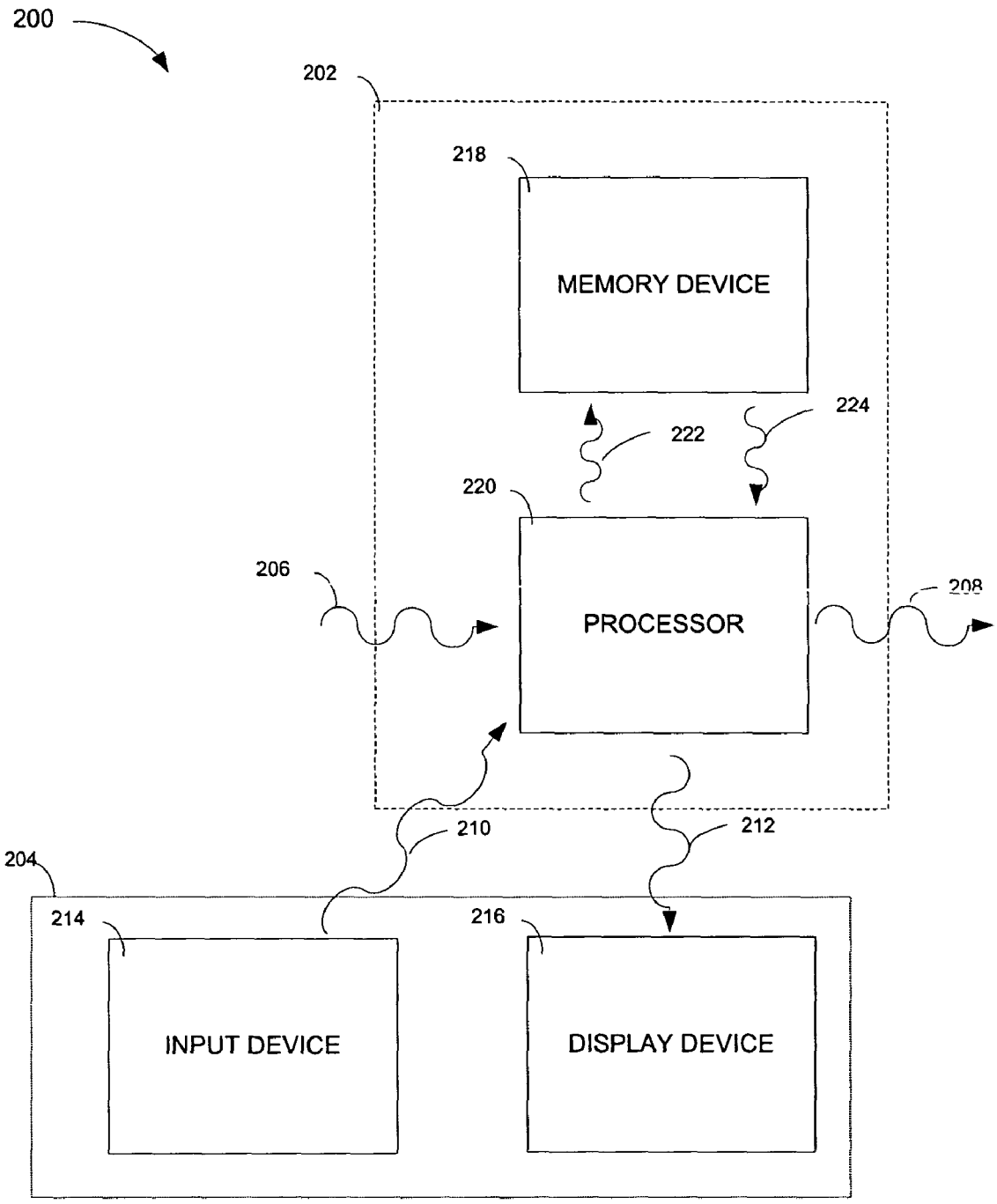
FIG. 6 is a preferred embodiment of a toner-controlled print contoller.

The toner-controlled pre-printing procedure may generally be implemented in the toner-driven printer control device shown in FIG. 6. This toner-driven printer control device 202 generally includes a control module 202 and a user interface 204. All the components of the font-driven printer control device 200 are at least electronically or electromagnetically (including optically) coupled to each other and to the printer so that the signals 210, 212, 222 and 224 may be communicated among the components as indicated, and so that the control signal 208 may be communicated to a print engine or directly to a printer. Based on input from an operator communicated through the user interface 204 via an input signal 210, the control module 202 produces a control signal 208 that contains instructions for a print engine (not shown). The control signal 208 is actually a plurality of control signals wherein one control signal may direct the print engine to suspend printing, such as when the print job is placed in the hold mode status, another control signal may direct the print engine to cancel printing, and another may direct the print engine to allow printing. If the proper conditions in the toner-controlled pre-printing procedure are met and the toner station installed in the printer is to be identified, the control signal 208 may also be based on a toner identification signal 206 identifying the type of toner or the toner station installed in the printer. The toner identification signal 206 may be produced by a toner identification apparatus such as those disclosed in the Friedrich application, or in the '816 patent. Alternatively, the toner identification signal may be produced by the user interface 204 in response to a toner identification made by an operator and communicated through the user interface 204 via the input signal 210, or the toner identification signal may be produced by the toner-driven printer control device 200, itself, from stored information.

The user interface 204 generally includes an input device 214 and an output device 216. The output device 216 is any type of visual, manual or audio device capable of communicating information from a processor or memory to a person. Examples of display devices include, but are not limited to, monitors, speakers and liquid crystal displays. The input device 214 may be any type of visual, manual, mechanical or audio device capable of communicating information from a person to a processor or memory. Examples of input devices include keyboards, microphones, voice recognition systems, trackballs and mice. Alternatively, the input and output devices 214 and 216, respectively, may be included in a single device such as a touch screens or a computer coupled to the processor via a network.

The printer control module 202 generally includes a processor 220 coupled to a memory device 218. The memory device 218 may be any type of fixed or removable digital storage device and (if needed) a device for reading the digital storage device including, floppy disks and floppy drives, CD-ROM disks and drives, optical disks and drives, hard-drives, RAM, ROM and other such devices for storing digital information. The processor 220 may be any type of apparatus used to process digital information. The memory device 220 stores, at least, a listing of toner stations and whether those toner stations are designated as special toner stations. It may also store overrides and suggestions and one or more database job tickets including the attributes of the database job tickets. Upon entry of a job ticket, the processor 220 will look for some indicator of the identity of the installed toner station such as a toner station identification signal 206, or an operator-identification communicated via input signal 210. The processor then accesses a table that includes either a plurality of toner identification signals or a plurality of operator-identifications, and the name of the toner station identified either with each toner identification signal or each operator-identification, respectively. This table is stored in the memory device 218 and the processor requests information from the table via the processor signal 222 and uses the information in the table communicated to the processor via the memory signal 223 to identify the installed toner station. Once the toner station has been identified, the processor 206 requests information from the memory device 200 via the processor signal 222 to determine if the installed toner station has been designated as a special toner station.

Once the processor 220 has determined that either the hold jobs mode is enabled for all toner stations or the installed toner station is a special toner station, the processor 220 will again access the memory device 218 to determine if overrides and suggestions are enabled and if any overrides and suggestions have been defined for the print ticket. If overrides and suggestions have been enabled and defined for the print job they will be communicated to the processor via the memory signal 224 and the processor 220 will apply them to the job ticket. The processor 220 then determines if there is a corresponding database job ticket by requesting information relating to a database job ticket that has the same job name as the job ticket. If such a corresponding database job ticket exists in the memory device 218, the memory device will communicate the related information to the processor 220 via memory signal 224 and the processor will apply the attributes of the corresponding database job ticket to the job ticket attributes. The processor may then produce a control signal 208 with directions indicating that printing should be allowed. These directions will also include the job ticket attributes. If, however, there is no corresponding database job ticket, the processor will activate the hold mode procedure and place the print job into a hold mode by producing a control signal 208 with directions indicating that printing should be suspended. The processor 220 then determines whether manual changes are enabled for the print ticket by accessing information relating to the print ticket in the memory device 224. If the processor 220 determines that manual changes are allowed, the processor 220 will allow the operator to change job ticket attributes and may allow the operator to apply attributes from a corresponding job ticket. Once the processor 220 has implemented the operator's manual changes or if the printer 220 determined that manual changes were not permitted, the processor 220 will produce a control signal 208 including the job ticket attributes and directions indicating that printing should be allowed. Additionally, if enabled, the processor 220 will send notification of the print when the print job is complete to specified individuals and will include specified information.

Figure 1:
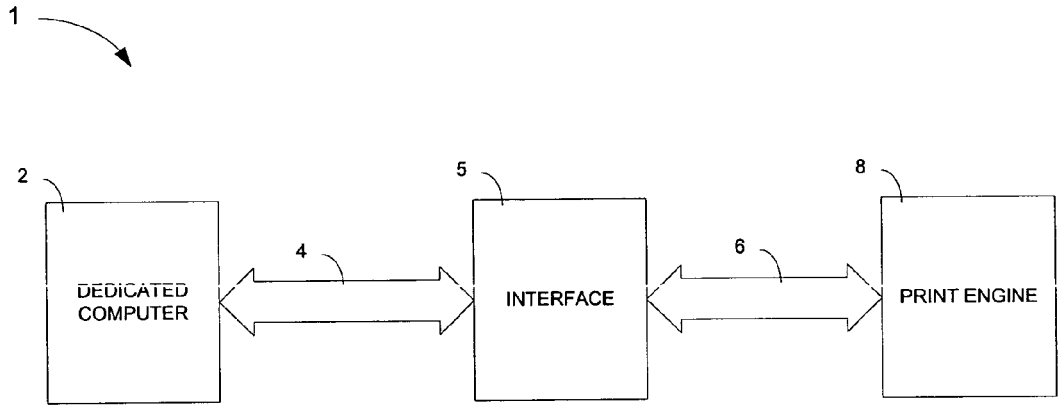
FIG. 1 (PRIOR ART)
FIG. 1 is a block diagram of a prior art commercial printer.

In one embodiment, the printer control module can be implemented in a commercial printer like the one shown in FIG. 1 without adding any additional hardware. Specifically, the printer control module (202 in FIG. 6) can be implemented in the dedicated computer 2, using the memory, processor, input and output mechanisms of the dedicated computer 2 for the memory device, processor, input device and output device of the print control module. In this embodiment, the processor of the dedicated computer produces the control signal that is communicated to the print engine 8 via (if necessary) an interface 5 through the dedicated computer coupling 4 and (if necessary) the interface coupling 6. In a similar manner, the printer control module can be implemented for a non-commercial printer using the general purpose computer from which the documents to be printed are communicated. In another embodiment, the printer control module (200 in FIG. 6) is an apparatus separate from the dedicated computer of a commercial printer or the general purpose computer of a non-commercial computer.

Implementations and embodiments of the toner-driven printer control algorithm as shown generally in FIGS. 2, 3 and 4 and the more specific embodiments such as the embodiment shown in FIG. 5, also include computer readable software code. Referring to FIG. 6, such code may be stored in the processor 220, the memory device 218 or on any other computer-readable storage medium. Alternatively, the code may be encoded in a computer readable electronic or optical signal. The code may be object code or any other code describing or controlling the functionality described herein. The computer readable storage medium may be a magnetic storage disk such as a floppy disk, an optical disk such as a CD-ROM disk, semiconductor memory or any other physical object storing program code and/or associated data.

The toner-driven printer control algorithm as shown generally in FIGS. 2, 3 and 4 and the more specific embodiments such as the embodiment shown in FIG. 5, may also include assigning states to the print job at some of the steps. States help define the status or current action of the printer. These states may include "canceled," "printing," "printed," "approved," and "not approved." The "not approved" state indicates that the print job is in the suspended state and is awaiting operator approval before allowing printing. This state may be assigned to the print job after the toner-driven printer control algorithm has entered the hold mode procedure which has placed the print job into hold status. The "printing" status indicates that the print job has been allowed to print and is currently in the process of being printed. This state may be assigned to the print job after the toner-driven printer control algorithm has allowed printing. The "printed" state indicates that printing has been completed. The "canceled" state indicates that printing has been canceled. This state may be assigned to a print job at any time the print job has been canceled by the operator or by other means.

Figure 7:
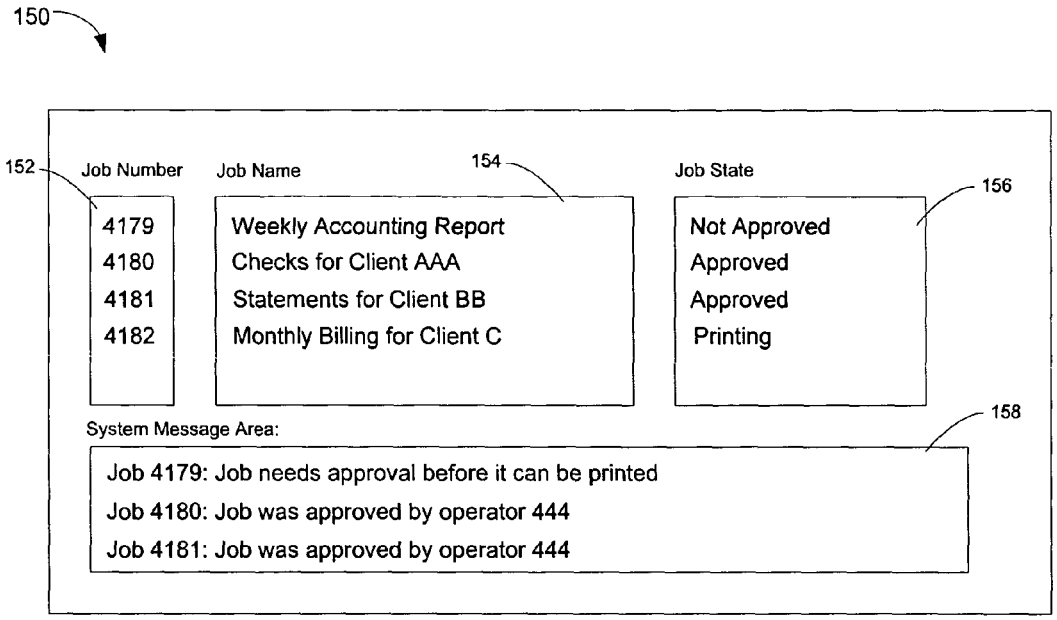
FIG. 7 is a preferred embodiment of a user-interface for a toner-controlled pre-printing procedure.

The states are generally communicated to the operator using the user interface 204 of FIG. 6. In one example, the user interface 204 is a touch screen that communicates with an operator through a series of screen shots. A sample screen shot of the touch screen is shown in FIG. 7 and indicated by reference number 150. The sample screen shot 150 includes several fields 152, 154, 156 and 158, wherein each field communicates information about a print job. Field 152 communicates the job number, field 154 communicates the job name, field 156 communicates the state of the job, and field 158 communicates other information.

Figure 8:
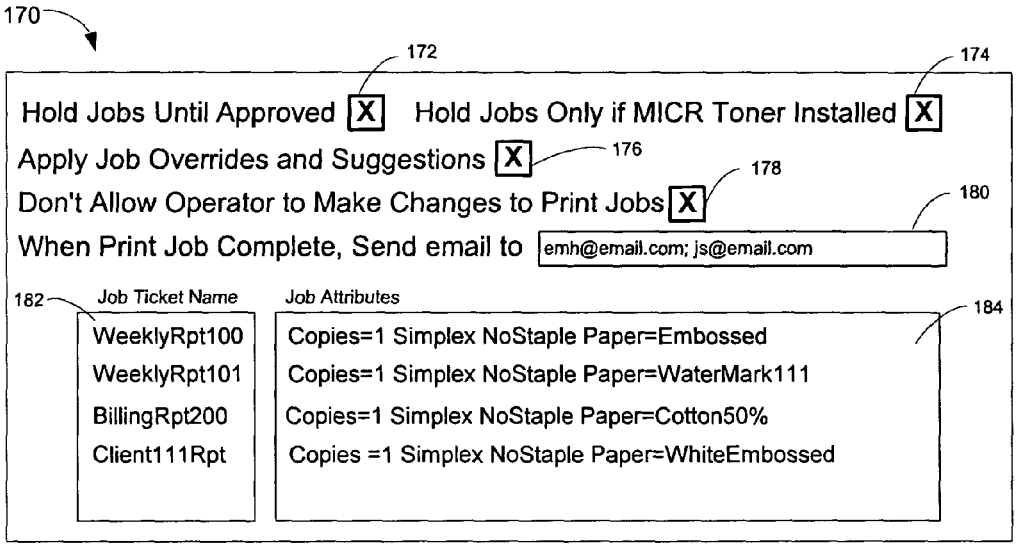
FIG. 8 is another preferred embodiment of a user-interface for a toner-controlled pre-printing procedure.

Another example of a screen shot of a touch screen is shown in FIG. 8 and indicated by reference number 170. This screen shot 170 is an example of an interface that can be used to define job tickets and their attributes, enable the hold jobs mode and enable this mode only for a specific toner such as MICR toner, enable and define overrides and suggestions, enable or disable manual changes to the job ticket and enable send notification. The job names of certain job tickets are shown in field 182 and field 184 indicates the attributes assigned to each job ticket. If any of these job tickets and their attributes are saved into memory, they will become database job tickets. In the screen shot 170, for example, the job ticket named WeeklyRpt100 has the following attributes assigned to it: only 1 copy is to be printed, printing is to be in simplex mode, the copy printed is not to be stapled and the paper to be used is embossed. The hold jobs mode is enabled by placing an "X" or other character or indication in the "Hold Jobs Until Approved" checkbox 172, and disabled by removing the "X." Enabling hold job modes is likewise enabled and disabled by placing or removing, respectively, an "X" in the "Hold Jobs Only if MICR Toner Installed" checkbox 174. Likewise, overrides and suggestions may be enabled or disabled using the "Apply Job Overrides and Suggestions" checkbox 176. Enabling manual changes involves not placing or removing an "X" from the "Don't Allow Operator to Make Changes to Print Jobs" checkbox 178 and is disabled by placing an "X" in the checkbox 178. Finally, the send notification feature is enabled by placing the email address or addresses to which notification is to be sent in the email box 180. When an email address is or email addresses are placed in the email box 180, a notification, including the job ticket will be sent to the addressee(s) after a print job is complete. The foregoing is meant only as an illustration and all the modes and the send notification may be enabled or disabled, and the attributes may be assigned to the job ticket using any suitable indication. The manner in which modes, attributes and send notification are enabled, disabled and defined will, in some part, be a function of the characteristics of the user interface used.

Figure 9:
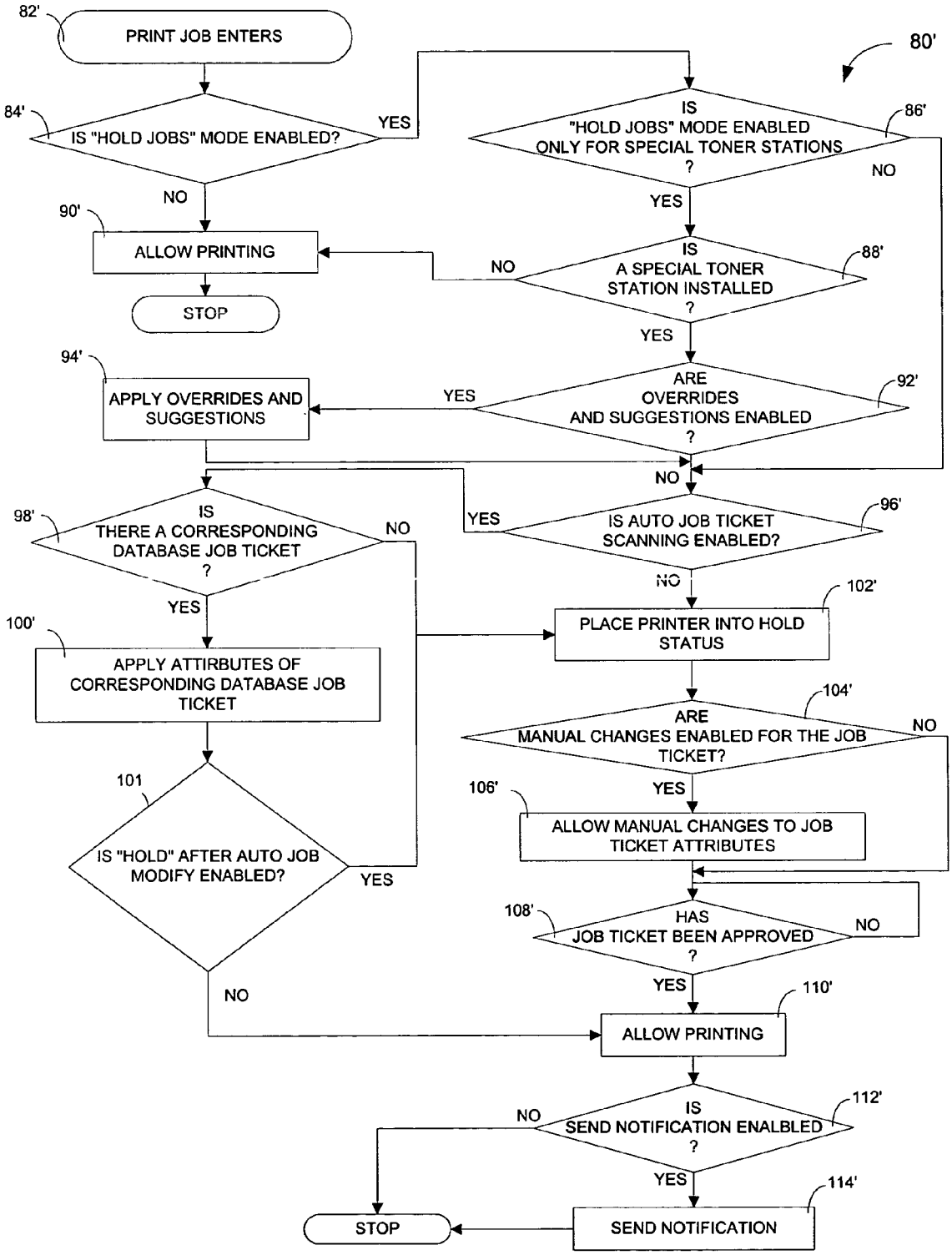
FIG. 9 is a preferred embodiment of a toner-controlled pre-printing procedure wherein the MICR toner station is a special toner station.

FIG. 9 shows an example of the toner-controlled pre-printing procedure wherein an MICR toner station is defined as a special toner station 80'. Toner stations may be defined as special toner stations by including their name in a list of special toner stations. Alternately, one or more toner stations may be presented from which the special toner stations may be chosen. Generally, determining which toner stations are special toner stations is done prior to entering any print jobs. After a print job including a print ticket enters 82', it will be determined whether the hold jobs mode is enabled 84', which determines whether the toner-controlled pre-printing procedure is activated. Enabling or disabling the hold jobs mode is done prior to entering a print job. If the hold jobs mode is enabled, the toner-controlled pre-printing procedure will be activated and it will be determined for which toner stations the hold jobs mode is enabled 86'. In this case, the hold jobs mode has been enabled for MICR toner stations. However, it must be determined if the hold jobs mode is enabled for all toner stations or only special toner stations 86'. If the hold jobs mode is enabled only for special toner stations, the toner-controlled pre-printing procedure will activate the toner station identification procedure. It will then be determined if the toner station installed in the printer is a special toner station. If the MICR toner station is not installed in the printer, the print job will be allowed to print 90'.

However, if a special toner station, such as an MICR toner station, is installed, or if the hold jobs mode is enabled for all toner stations, the hold mode procedure will be activated. The print job will be placed into a hold status and job ticket attributes will be automatically applied. Some, all or none of the job ticket attributes may be automatically applied depending on how or whether overrides, suggestions and database job tickets are defined. Automatically determining job ticket attributes includes applying existing overrides and suggestions and applying the attributes of a corresponding database job ticket to the job ticket (steps 92', 94', 96', 98' and 100'). Before overrides and suggestions are applied 94', it is determined whether overrides and suggestions are enabled 92'. Whether or not overrides and suggestions are applied, it is then determined whether auto job ticket scanning is enabled 96'. If auto job ticket scanning is enabled it will be determined if a corresponding database job ticket 98 exists. If there is a corresponding database job ticket, the attributes of the database job ticket will be applied to the job ticket 100'. It will then be determined in a step 101 if "hold" after job modify is enabled. If no, then the job will be allowed to print 110' and if yes, then the printer will be placed into the hold status 102.

While the print job is placed into the hold status 102, it will be determined if manual changes are enabled for the job ticket 104. If manual changes are enabled, the operator will be able to make changes to the job ticket 106 attributes. However, the step of enabling manual changes 104 may be eliminated. As a convenience to the operator, the operator may be permitted to apply all the attributes from an existing job ticket (possibly stored in a database) to the current job ticket. This could be done by selecting a job ticket name from a list of job ticket names. Afterwards, the operator may choose to modify an individual attribute of the job ticket. It will then be determined if the job ticket has been approved 108. This determination will continue until the job ticket is approved. The job ticket may be approved by the operator or by another individual. Once the job ticket is approved, printing will be allowed 110. Finally, after printing is allowed 110, it will be determined if send notification is enabled 114. The send notification feature allows print jobs associated with special toner stations to be tracked and monitored. Before the print job is entered, an individual may enable this feature and specify to whom the notification is to go and what the notification is to contain. Preferably, the notification will contain the job ticket, including all job ticket attributes, but may contain any information relating to the print job.

Although the methods and apparatuses disclosed herein have been described in terms of specific embodiments and applications, persons skilled in the art can, in light of this teaching, generate additional embodiments without exceeding the scope or departing from the spirit of the claimed invention. Additionally, unless referring specifically only to a commercial printer, the term "toner station" is used herein to denote both toner stations for commercial printers and toner cartridges for a non-commercial printers.

What is claimed is:

1. A toner-controlled printer controller, comprising:

a user interface for receiving print jobs comprising job tickets;

a processor coupled to the user interface;

a memory device coupled to the processor, wherein the memory device stores at least the job ticket received by the user interface, and a list of special toner stations; and wherein the processor determines if a toner-controlled pre-printing procedure is enabled only for special toner stations, wherein if the toner-controlled pre-printing procedure is enabled only for the toner stations included in the list of special toner stations, it is determined whether an installed toner station is included in the list of special toner stations and if the processor determines that the installed toner station is included in the list of special toner stations, the processor executes a hold mode procedure wherein printing is allowed if the job ticket is approved or if a corresponding database job ticket exists.

2. A toner-controlled printer controller, as claimed in claim 1, wherein the hold mode procedure comprises automatically determining zero or more job ticket attributes for a job ticket, wherein:

the user interface allows enablement of overrides and suggestions, and auto job ticket scanning;

the memory additionally stores existing overrides and suggestions, and at least one database job ticket wherein each of the at least one database job tickets include at least one attribute; and the processor applies the existing overrides and suggestions stored in the memory device to the job ticket if overrides and suggestions are enabled, determines if a corresponding database job ticket exists, and applies attributes of the corresponding database job ticket to the job ticket if the corresponding database job ticket exists.

3. A toner-controlled printer controller, as claimed in claim 1, wherein the toner-controlled preprinting procedure comprises placing the print job into a hold status until the job ticket is approved, wherein:

the user interface allows enablement and disablement of manual changes to the job ticket; and the processor allows manual changes to the job ticket attributes, if manual changes to the job ticket are enabled, and determines if the job ticket has been approved.

4. A toner-controlled printer controller, as claimed in claim 1, wherein the toner-controlled pre-printing procedure comprises allowing printing if the processor has determined that the hold mode procedure is not enabled, the installed toner station is not included in the list of special toner stations, the corresponding database job ticket exists, or when the job ticket is approved.

5. A toner-controlled print controller comprising:

a user interface for receiving print jobs wherein each print job comprises a job ticket, and allowing enablement of overrides and suggestions, auto job ticket scanning, and manual changes to the job ticket;

a processor coupled to the user interface;

a memory device coupled to the processor, wherein the memory device stores any job ticket received by the user interface, a list of special toner stations; existing overrides and suggestions, and at least one database job ticket wherein each of the at least one database job tickets include at least one attribute; and wherein the processor determines if a hold mode procedure in enabled, wherein if the hold mode procedure is enabled, determines if the hold mode is enabled only for toner stations included in the list of special toner stations, wherein if the hold mode is enabled only for toner stations included in the list of toner stations, determines whether an installed toner station is included in the list of special toner stations, wherein if the installed toner station is included in the list of special toner stations, the processor (1) automatically determines zero or more job ticket attributes for a job ticket, wherein the processor applies the existing overrides and suggestions stored in the memory device to the job ticket if overrides and suggestions are enabled, determines if one of the at least one database job tickets is a corresponding database job ticket, wherein if one of the at least one database job tickets is a corresponding database job ticket, applies the at least one attribute of the corresponding database job ticket to the job ticket, (2) if one of the at least one database job tickets is not the corresponding database job ticket, places the job ticket into a hold status until the job ticket is approved, wherein the processor allows manual changes to the job ticket attributes if manual changes to the job ticket are enabled and determines if the job ticket has been approved, and (3) allows printing if the processor determines that the hold mode procedure is not enabled, the installed toner station is not included in the list of special toner stations, if one of the at least one database job tickets is the corresponding database job ticket or if the job ticket has been approved.

6. A toner-controlled printer, comprising a print engine for printing print jobs wherein the print jobs comprise a job ticket;

and a dedicated computer coupled to the print engine comprising:

a user interface for receiving the job tickets;

a processor coupled to the user interface and to the print engine wherein the processor communicates the job tickets to the print engine;

a memory device coupled to the processor, wherein the memory device stores any job ticket received by the user interface, a list of special toner stations; existing overrides and suggestions, and at least one database job ticket wherein each of the at least one database job tickets include at least one attribute; and wherein the processor determines if a hold job mode is enabled, wherein if the hold job mode is enabled, determines if the hold job mode is enabled only for the printer stations included in the list of special toner stations, wherein if the hold job mode is enabled only for the printer stations included in the list of special toner stations, determines if an installed toner station is included in the list of special toner stations, wherein if the processor determines that the installed toner station is included in the list of special toner stations, the processor (1) automatically determines zero or more job ticket attributes for a job ticket, wherein the processor applies the existing overrides and suggestions stored in the memory device to the job ticket if overrides and suggestions are enabled, determines if one of the at least one database job tickets is a corresponding database job ticket, wherein if one of the at least one database job tickets is a corresponding database job ticket, applies the at least one attribute of the is a corresponding database job ticket to the job ticket, (2) if one of the at least one database job tickets is not the corresponding database job ticket, places the job ticket into a hold status until the job ticket is approved, wherein the processor allows manual changes to the job ticket attributes if manual changes to the job ticket are enabled and determines if the job ticket has been approved, and (3) allows printing if the processor determines that the hold job mode is not enabled, the installed toner station is not included in the list of special toner stations, if one of the at least one database job tickets is the corresponding database job ticket or if the job ticket has been approved.

* * * * *